US011111609B2

(12) United States Patent
Özden et al.

(10) Patent No.: US 11,111,609 B2
(45) Date of Patent: Sep. 7, 2021

(54) ELASTIC FABRIC AND PROCESS OF PREPARATION

(71) Applicant: Sanko Tekstil Isletmeleri San. Ve Tic. A.S., Inegol-Bursa (TR)

(72) Inventors: Erdogan Baris Özden, Inegol-Bursa (TR); Ertug Erkus, Inegol-Bursa (TR); Mustafa Zeyrek, Inegol-Bursa (TR); Fatma Korkmaz, Inegol-Bursa (TR)

(73) Assignee: SANKO TEKSTIL ISLETMELERI SAN. VE TIC. A.S., Inegol (TR)

( * ) Notice: Subject to any disclaimer, the term of this patent is extended or adjusted under 35 U.S.C. 154(b) by 414 days.

(21) Appl. No.: 15/526,973

(22) PCT Filed: Mar. 29, 2016

(86) PCT No.: PCT/EP2016/056831

§ 371 (c)(1),
(2) Date: May 15, 2017

(87) PCT Pub. No.: WO2016/151149

PCT Pub. Date: Sep. 29, 2016

(65) Prior Publication Data

US 2018/0298527 A1 Oct. 18, 2018

(30) Foreign Application Priority Data

Mar. 26, 2015 (EP) ..... 15161213

(51) Int. Cl.

| | |
|---|---|
| ***D02G 3/32*** | (2006.01) |
| ***D03D 15/47*** | (2021.01) |
| ***D03D 15/56*** | (2021.01) |

(52) U.S. Cl.

CPC ..... *D02G 3/328* (2013.01); *D03D 15/47* (2021.01); *D03D 15/56* (2021.01); *D10B 2321/02* (2013.01); *D10B 2321/021* (2013.01); *D10B 2321/022* (2013.01); *D10B 2331/02* (2013.01); *D10B 2331/04* (2013.01);

(Continued)

(58) Field of Classification Search

USPC ..... 139/419, 421, 423, 422; 442/182; 28/153, 155, 156, 167

See application file for complete search history.

(56) References Cited

U.S. PATENT DOCUMENTS

| | | | |
|---|---|---|---|
| 6,659,139 | B2 | 12/2003 | Laycock et al. |
| 7,762,287 | B2 | 7/2010 | Liao |
| 2012/0244771 | A1 | 9/2012 | Tharpe, Jr. et al. |

FOREIGN PATENT DOCUMENTS

| | | |
|---|---|---|
| JP | 2001303375 | 10/2001 |
| JP | 2002317348 | 10/2002 |
| JP | 2013544983 | 12/2013 |

(Continued)

OTHER PUBLICATIONS

International Search Report and written opinion dated Aug. 5, 2016 for corresponding PCT/EP2016/056831.

(Continued)

*Primary Examiner* — Lynda Salvatore

(57) ABSTRACT

In a woven fabric all warp and weft yarns are elastic, all weft and warp yarns have a stretchable core comprising a first elastic fiber and a second fiber that is less elastic than said first fiber, and the elasticity of the fabric in warp direction is at least 25% and elasticity of the fabric in weft direction ($E_{weft}$) is at least 30%, preferably at least 40%.

9 Claims, 3 Drawing Sheets

(52) U.S. Cl.
CPC .... *D10B 2331/10* (2013.01); *D10B 2401/061* (2013.01); *D10B 2501/00* (2013.01); *D10B 2501/06* (2013.01)

(56) References Cited

FOREIGN PATENT DOCUMENTS

| | | |
|---|---|---|
| JP | 2016507699 | 3/2016 |
| WO | 2008130563 | 10/2008 |
| WO | 2012062480 | 5/2012 |
| WO | 2013148659 | 10/2013 |
| WO | 2014113207 | 7/2014 |
| WO | 2015032097 | 3/2015 |

OTHER PUBLICATIONS

European Search Report and written opinion dated Sep. 21, 2015 for priority application No. 15161213.2.
Office Action issued by the CN Patent Office on Jun. 11, 2019 for corresponding CN application No. 20168002949.2, relavant English translation and reporting letter of the CN local agent.
Office ACtion dated Mar. 3, 2020 from the JP patent office for corresponding JP application No. 2017-534801.
Office ACtion dated Jan. 6, 2020 from the BR patent office for corresponding BR application No. 112017005424-8 and relevant letter from the BR local agent.
Office Action issued by the JP Patent Office dated Dec. 1, 2020 for corresponding JP application No. 2017-534801.

ELASTIC FABRIC AND PROCESS OF PREPARATION

RELATED APPLICATION

This application is a US national stage application of international application number PCT/EP2016/056831, filed 29 Mar. 2016, which designates the US and claims priority to European Application EP 15161213.2, filed 26 Mar. 2015, the contents of each of which are hereby incorporated by reference as if set forth in their entireties.

FIELD OF THE INVENTION

The present invention relates to the manufacture of woven fabrics with stretch in warp and weft direction. It specifically relates to stretchable fabrics including a core spun yarn system and to a process for the preparation thereof.

BACKGROUND ART

Elastic woven fabrics have been produced for many years. In order to produce elastic fabrics, elastic yarns are used. In this kind of fabrics, elastic yarns provide both aesthetic, and elasticity functions. The most common way of producing stretch fabrics is weft-stretch fabrics. Weft-stretch fabrics have non-elastic warp yarns and elastic weft yarns. In these fabrics different kinds of elastic weft yarns such as corespun elastane yarns, twisted elastane yarns, etc. are used. However, as far as weft-stretch fabrics are not stretchable along the warp direction, are usually comfortable but their comfort level is not enough during long usage times, as they do not follow the movements of the body.

In order to solve this problem, several types of fabrics have been developed, for example warp-stretch fabrics, and the so called "bi-stretch" fabrics, i.e. fabrics that can be stretched both in weft and warp direction. This bidirectional stretchability, i.e. ability to be elongated, is obtained by including elastic yarns in both warp and weft direction.

However, also these kinds of fabrics present drawbacks.

Warp-stretch fabrics for example, when comprising bare elastomeric ends, can present grin-through of the elastomer, i.e. the exposure, in a fabric, of bare elastomeric filaments to view. Grin-through can be observed as an undesirable glitter-like effect on the surface of the fabric. Therefore some ways to control elasticity in bi-stretch fabrics were devised.

U.S. Pat. No. 6,659,139 describes a way to reduce grin-through of bare elastomer in warp direction of twill fabric. The fabric disclosed in U.S. Pat. No. 6,659,139 can have also bidirectional stretch (warp and weft), but the percentage values of stretchability are poor.

Bi-stretch fabrics known in the art have also several problems, such as the growth of the fabric, and little recovery after stretching.

WO2013/148659 discloses a woven fabric comprising a corespun elastic base yarn and a separate control yarn, to avoid overstretching. Control yarn is hidden inside the fabric by the adjacent elastic corespun base yarn.

A stretch fabric with separated elastic yarn system is disclosed in U.S. Pat. No. 7,762,287, wherein a rigid yarn is used to form the main body of fabrics. Elastic composite yarns are hidden inside fabrics and provide the stretch and the recovery. However, the fabric disclosed in U.S. Pat. No. 7,762,287 has reduced stretchability in the warp and/or weft direction.

US 2012/0244771 discloses elastic composite yarns having a stretchable core and a sheath of spun staple fibers; the core is made of an elastic filament and an inelastic filament that is loosely wound around the elastic filament to control the stretching. The above disclosed solution provides bi-stretch fabrics that have acceptable recovery characteristics but are provided with too low elasticity (i.e. stretch), namely about 10-12% warp direction and 17-20% in weft direction.

WO2008/130563 discloses elastic yarns having a core made of an inelastic fiber loosely wound around an elastic fiber.

WO 2012/062480, in the name of the present applicant Sanko Tekstil, discloses elastic composite yarns having elastic stretchable core and a sheath of inelastic staple fibers; the core is made of an elastic filament and a less elastic filament attached together by coextrusion, intermingling or twisting. The less elastic filament controls the stretch and provides recovery so as to move as a single fiber that has high elasticity and very good recovery properties.

Another problem is the poor behaviour of highly elastic bi-stretch fabrics: after few stretch and return cycles, the known fabrics are not able to retain the original aspect. The fabrics lose their original hand and appearance and show curling, creasing and torqueing to such a degree that the garments made with said fabrics have to be discarded after a short time.

A problem of the known bi-stretch fabrics, for example denim fabrics, is that it is really difficult to obtain a fabric with the appropriate balance of physical characteristics, suitable for garments able to combine desirable visual and tactile aesthetics, with good performance in stretchability, recovery (i.e. limited growth of the fabric after having been elongated or stretched) and comfort.

For example, fabrics with a high amount of elastic yarns can have problems of loss of aesthetic, especially because of growth; on the contrary, fabrics with low values of elasticity can be uncomfortable in daily life. Additionally, prolonged usage of stretch fabrics can cause a loss in recovery power of the fabric, thus causing the growth of the fabric. Another problem of the known fabrics, for example denim fabrics, is the poor body holding, i.e. body shaping power.

The above problems of recovery power, comfort in use and holding/shaping power of the fabric are particularly present in the final garments that are styled in the so-called skinny or super-skinny models, i.e. models that require a total or almost total adherence of the garment to the body of the user.

In view of the above mentioned problems, there is a need for new fabrics able to combine high elasticity and good aesthetics; for example, there is a need in the market for new fabrics having an improved holding power and recovery, reduced growth, combined with good visual and tactile aesthetics. In particular, there is a need for new bi-stretch fabrics, for example denim fabrics, with an improved holding/shaping power, having an improved recovery and reduced growth.

More in particular, there is a need of new bi-stretch fabrics, such as denim fabrics, with an improved body holding power and fabrics that can follow any body movement.

SUMMARY OF THE INVENTION

An aim of the present invention is to solve the problems of the prior art, providing a bi-stretch woven fabric that has an improved holding power, and that provides to the garments made with the fabric a great freedom of movement, thus avoiding the feeling of tightness and discomfort.

Another aim of the present invention is to provide a bi-stretch woven that combines good performance, such as improved body holding/shaping power, improved recovery and reduced growth, with good aesthetics.

A further aim of the present invention is to provide a process for producing a bi-stretch woven fabric, as mentioned above.

Still a further aim of the present invention is to provide a clothing article comprising a bi-stretch woven fabric, as mentioned above.

These and other aims are achieved by a woven fabric according to claim 1, that can be produced by means of a process according to claim 14, and that can be used to provide a clothing article according to claim 21.

Therefore, an object of the present invention is a woven fabric having elastic warp yarns and elastic weft yarns, said yarns having a stretchable core and an inelastic fiber sheath that covers said core, wherein all weft and warp yarns have a stretchable core comprising a first elastic fiber and a second fiber that is less elastic than said first fiber, and the elasticity of the fabric in warp direction is at least 25% (measured according to ASTM D3107—Stretch, after 3 home washes) and elasticity of the fabric in weft direction ($E_{weft}$) is at least 30%, preferably at least 40% (ASTM D3107—stretch, after 3 home washes).

Preferably, the woven fabric has elasticity in weft direction ($E_{weft}$) that is higher than the elasticity in warp direction ($E_{warp}$). A woven fabric wherein the elasticity in the warp direction is higher than elasticity in the weft direction is also possible.

In the ASTM D3107, a sample may be stretched by means of a weight of 3.0 lb or 4.0 lb. It has been proven that there are no significant differences in the test results if either a 3.0 lb or 4.0 lb weight is used. In the present disclosure, stretch according to ASTM D3107 was measured by means of a 3.0 lb weight.

Preferably, in a woven fabric according to the present invention, said first fiber and second fiber are connected together by intermingling, twisting or coextrusion to control elongation of said first fiber.

Therefore, an object of the present invention is an elastic woven fabric in which all weft and warp yarns have a stretchable core comprising a first elastic fiber and a second fiber that is less elastic than said first fiber, said first fiber and second fiber are connected together by intermingling, coextrusion or twisting to control elongation of said first fiber, and in which the elasticity of the fabric in warp direction is at least 25% (measured according to ASTM D3107—Stretch, after 3 home washes) and the elasticity of the fabric in weft direction ($E_{weft}$) is at least 30%, preferably at least 40%, most preferably above 45% (ASTM D3107—stretch, after 3 home washes) and is the same or higher than the elasticity in warp direction ($E_{warp}$). In other words, the fabric of the invention can stretch at least 25% in warp direction and at least 30%, preferably at least 40%, in weft direction when measuring according to ASTM D3107 (modified stretch after 3 home washes) as above mentioned In a preferred embodiment, the warp yarns of the fabric have a twist level (i.e. number of twists per length unit) with a twist multiple (TM) in the range of 2.5 to 6, more preferably 3 to 5, most preferably 3.5 to 4.7. As known, the twist multiple is a number calculated as follows: Twist level (measured in twist per inch)=Twist Multiple*√yarn count (measured in English Cotton Number), i.e.

$$\text{Twist}=TM\sqrt{NE}$$

so that $$TM = \frac{\text{Twist}}{\sqrt{NE}}$$

The twist level and the count are those of the warp yarn, i.e. the total twist level and the total count of the yarn used as warp yarn.

Also, the twist level referred above is the one of the finished fabric, before washing.

Thanks to this, the woven fabric can be provided with particularly high elasticity in the warp direction, and also with a good visual effect, and a with a good feeling for the user when touched (i.e. fabric is not too hard when touched). In a further possible embodiment, the fabric undergoes finishing steps but does not undergo the usual heat setting treatment for elastic yarns.

Heat treatment, i.e. heat setting of the fabric is a well-known step of traditional processes of fabric preparation, used e.g. to give dimensional stability to the elastic fabric after weaving by heating the fabric to a setting temperature for the elastomers of the elastic core of the yarns. E.g., the temperature for heat setting of lycra is about 180° C. Heat treatment at lower temperatures, as in sanforization, at about 110° C. is usually carried out in the present invention's process. According to an aspect of the invention, elasticity in the warp direction ($E_{warp}$) is at least 25%, and is preferably comprised in the range of 25% to 600%, preferably 30% to 90%, more preferably 30% to 60% (ASTM D3107 MODIFIED (Stretch) after 3 home wash) and elasticity in the weft direction ($E_{weft}$) is at least 30%, preferably at least 40%, most preferably above 45% and $E_{weft}$ is preferably comprised in the range of 30% to 600%, preferably 30% to 140%, more preferably 35% to 125%, most preferably 40% to 125% (ASTM D1037 MODIFIED (Stretch) after 3 home wash).

In general, in a preferred embodiment, at least one between warp and weft elasticity is above 45%.

In an exemplary embodiment, the ratio $E_{weft}/E_{warp}$ or $E_{warp}/E_{weft}$ is in the range of 1.1/1.0 to 20.0/1.0, more preferably 1.5/1.0 to 8.0/1.0, most preferably 1.4/1.0 to 3.0/1.0. In some embodiments the ratio $E_{weft}/E_{warp}$ or $E_{warp}/E_{weft}$ is in the range 1.8/1.0 to 3.0/1.0.

Suitable elastic core spun yarns are those disclosed in WO2008/130563 and in WO 2012/062480.

According to another aspect of the invention, the first fiber is a fiber that can stretch at least for 400% of its initial length, as elongation at break, and said second fiber is a fiber with elongation that is at least 20% of its initial length but less than the elongation of the first fiber, according to ASTM D3107. The first fiber and the second fiber are connected together as disclosed in mentioned applications, e.g. as mentioned at pages 9 and 10 of WO 2012/062480. In a preferred embodiment the first and second fibers are intermingled and the number of connecting points is within the range of 20 to 500 points per meter, more preferably in the rage of 50 to 200 points per meter. In another embodiment, first and second fibers are connected by twisting and the number of twists per meter is in the range of 20 to 1000 twists per meter, preferably 200 to 600 twists per meter, more preferably 300 to 600 twists per meter.

In a preferred embodiment of the invention, the core of the yarns are intermingled or twisted as per above discussion, and the fabric is not a heat-set fabric, i.e. the fabric has not undergone a thermal treatment, as it is generally done to set elasticity of the elastomeric fibers.

It was surprisingly found that an elastic woven fabric according to the present invention has an excellent elastic behaviour; in particular it is possible to use highly elastic yarns to obtain the claimed highly elastic fabric both warp and weft-wise, that was not possible with traditional fabrics and processes. In greater detail, the invention results in a fabric that can stretch up to 150% (ASTM D1037 MODIFIED (Stretch) after 3 home wash), or, in possible embodiments even over 150% (e.g. up to 600%), weftwise and that can return to its original shape after such a stretch: the fabric after the stretch is visually identical to the fabric before the stretch.

This is a very important advantage over prior art bi-stretch fabrics such as those disclosed in U.S. Pat. No. 7,762,287; the prior art fabrics could not withstand a stretching action as high as the claimed one for the invention fabric, without said known fabrics suffering visual damages in the form of undulations or torqueing of the fabric.

A further advantage is that it was observed that an elastic woven fabric having specific values of elasticity in the warp direction, as well as in the weft direction, shows an improved holding power (or shaping power); in particular, when the values of $E_{weft}$ and $E_{warp}$ are combined in a specific ratio. The present invention provides an elastic woven fabric, which comprises elastic yarns of the core spun type both warpwise and weftwise, so that all yarns of the fabric are elastic yarns. Preferably, in an exemplary embodiment, the fabric has specific values of elasticity and a specific ratio between $E_{warp}$ and $E_{weft}$: i.e. $E_{warp}$ is at least 25%, and $E_{weft}$ is equal to or higher than $E_{warp}$, preferably, $E_{weft}$ is about twice the value of $E_{warp}$ or specific ratio between $E_{weft}$ and $E_{warp}$: i.e. $E_{weft}$ is at least 25%, and $E_{warp}$ is equal to or higher than $E_{weft}$, preferably, $E_{warp}$ is about twice the value of $E_{weft}$ thus providing an improved body holding power and improved movement skills, a reduced growth of the fabric, and of the garments comprising the same.

A process for preparing said elastic woven fabric is also an object of the present invention. Said process is characterized by comprising the steps of providing corespun warp yarns and weft yarns having a stretchable core and an inelastic fiber sheath that covers said core, said stretchable core comprising a first elastic fiber and a second fiber less elastic than the first fiber; weaving said warp and weft yarns to provide a fabric where all warp and all weft yarns are said corespun yarns, (e.g. intermingled or twisted) and finishing said fabric to provide a fabric having elasticity in warp direction ($E_{warp}$) that is at least 25% (measured according to ASTM D3107—Stretch, after 3 home washes) and an elasticity in weft direction ($E_{weft}$) that is at least 30%, preferably at least 40%, most preferably above 45% (ASTM D3107—stretch, after 3 home washes).

In particular, in a process according to the invention said first fiber and second fiber are connected together by intermingling, coextrusion, or twisting to control elongation of said first fiber.

In an exemplary embodiment, said elasticity in weft direction ($E_{weft}$) is higher than the elasticity in warp direction ($E_{warp}$) or warp direction ($E_{warp}$) is higher than the elasticity in weft direction ($E_{weft}$)

Therefore, in a preferred embodiment, a process according to the invention is characterized by comprising the steps of providing corespun warp yarns and weft yarns having a stretchable core and an inelastic fibers sheath that covers said core, said stretchable core comprising a first elastic fiber and a second fiber less elastic than first fibers, said first fiber and second fiber are connected together by intermingling, coextrusing, or twisting, to control elongation of said first fiber; weaving said warp and weft yarns to provide a fabric where all warp and all weft yarns are said corespun yarns and finishing said fabric to provide a fabric having elasticity in warp direction ($E_{warp}$) that is at least 25% (measured according to ASTM D3107—Stretch, after 3 home washes) and an elasticity in weft direction ($E_{weft}$) that is at least 25%, preferably at least 30%, more preferably 40%, most preferably above 45% (ASTM D3107—stretch, after 3 home washes). Preferably $E_{weft}$ is higher than the elasticity in warp direction ($E_{warp}$). In an alternative embodiment, elasticity in the weft direction ($E_{weft}$) is at least 30% (measured according to ASTM D3107—Stretch, after 3 home washes) and an elasticity in warp direction ($E_{warp}$) is at least 25%, preferably at least 30%, more preferably 40%, most preferably above 45% (ASTM D3107—stretch, after 3 home washes) and it is higher than the elasticity in weft direction ($E_{weft}$)

As mentioned, in a preferred embodiment, the warp yarns of the fabric have a twist level having a twist multiple comprised between 2.5 and 6, more preferably between 3 and 5, most preferably between 3.5 to 4.7 in the finished fabric. As known, the twist multiple (TM) is a known factor that, multiplied by the square root of the count (measured with English Cotton number NE), gives the twist level of the yarn, i.e. the number of twist per inch of the yarn. In other words: twist level=TM*√NE.

The twist level of the warp yarn is the twist applied to the whole yarn, i.e. the twist visible on the external cover of the warp yarn.

During the fabric production steps, (e.g. at removal from the loom, at other finishing processes such as sanforizing) the fabric shrinks. The total number of twists in the warp yarns is substantially unchanged, but twist level in the warp yarn is increased after fabric shrinking, because the length of the fabric in the warp direction is reduced. During production of the fabric, the fabric shrinks down to 1 m in the warp direction. In such a condition there are still 200 twists in the warp yarn, but they are contained in 1 m, so that the twist level of the warp yarn in the fabric is 200 twists per meter (i.e. twice the initial one).

In general, thus, when preparing the warp yarn for a fabric according to the present invention, the twist level of the warp yarn to be used in the woven fabric production step is chosen as a function of the shrinkage of the fabric during the production step and of the desired twist level of the warp yarn in the finished fabric (e.g. the above mentioned range of values for the twist multiplier). In other words, the twist level of the warp yarn at the beginning of the fabric production, before weaving, i.e. the "initial" twist level, is chosen so that, after the warp yarns shrink due to the fabric production steps, the finished fabric is provided with warp yarns having the desired twist level.

The initial twist level of the warp yarn is thus lower than the twist level of the warp yarn in the finished fabric. Generally, the more the warp yarn is elastic, the more the fabric shrinks during the fabric production and, thus, the greater increase is obtained in the twist level of the warp yarns of the finished fabric. In particular, the twist level of the warp yarn before weaving is chosen to be smaller than the desired twist level of the warp yarn in the finished product, proportionally to the shrinkage of the fabric in the warp direction during fabric production. As an example, if the fabric shrinks for about 50% of its length in the warp direction during production (e.g. from 2 m down to 1 m), the initial twist level of the warp yarn is chosen to be half of the twist level in the finished fabric (e.g. the desired twist multiple for the warp yarn in the finished fabric is 6, then the initial twist level of the warp yarn—i.e. before weaving—is chosen to be 3).

In a further embodiment, the process of the invention does not include a step of heat setting of the fabric, i.e. the fabric of the invention does not undergo any heat treatment.

A further object of the present invention is a clothing article made of, or comprising, an elastic woven fabric according to the present invention.

The invention will be further disclosed with reference to the following figures that refer to exemplary and non limiting embodiments and features of the invention.

DETAILED DESCRIPTION

Figure 1B:
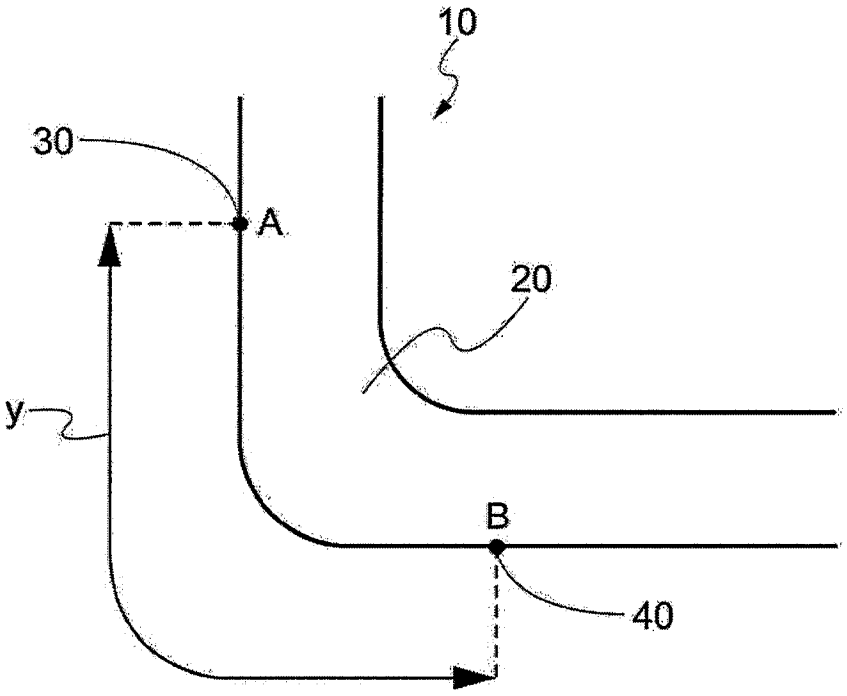
FIGS. 1*a* and 1*b* show how the minimum warp elasticity required can be determined.

The present invention relates to a woven fabric having elastic warp yarns and elastic weft yarns. The woven fabric of the present invention is characterised in that it has an elasticity, i.e. it can be stretched, in warp direction of at least 25%, preferably at least 30%, measured according to ASTM D3107 MODIFIED (Stretch) after 3 home wash. Preferably, elasticity of the fabric in weft direction ($E_{weft}$) is higher than the elasticity of the fabric in warp direction ($E_{warp}$) Alternatively, elasticity in weft direction ($E_{weft}$) is at least 30%, preferably at least 40%, most preferably above 45% measured according to ASTM D3107 MODIFIED (Stretch) after 3 home wash, and elasticity of the fabric in warp direction ($E_{warp}$) is higher than the elasticity of the fabric in weft direction ($E_{weft}$)

In view of the fact that the woven fabric of the present invention is elastic in both warp and weft direction, it can be defined as a "bi-stretch" woven fabric. As used herein, "$E_{weft}$" and "$E_{warp}$" respectively refer to the percentage of stretch in weft and in warp, measured according to ASTM D3107 MODIFIED (Stretch) after 3 home wash.

As used herein, the term "elastic yarn" refers to a yarn comprising an elastomeric fiber, covered by a wrap, i.e. a core-spun yarn, and which provides characteristics of elasticity to the woven fabric.

Suitable fibers for the elastic filament are: polyurethanic fibers such as elastane (e.g. Lycra, dorlastan), spandex (RadicciSpandex Co), lastol (Dow Chemical XLA).

Suitable fibers for the less elastic, control, filament are: polyamides such as nylon (e.g., nylon 6, nylon 6,6, nylon 6,12 and the like), polyester, polyolefins such as polypropylene and polyethylene, mixtures and copolymers of the same, PBT and bicomponent filaments namely elastomultiesters such as PBT/PET and PTT/PET filaments. Suitable staple fibers for the sheath are polyester fibers, cotton, cotton blended, regenerated cellulose fibers, cotton synthetic fibers, all type of animal hair blends and natural fibers, preferably cotton fibers, that can be dyed.

Preferred elastic yarns for the present invention are disclosed in WO2012/06248; for all these yarns, when the two filaments of the core are twisted, the twisting number is at least 20 twist per meter, preferably at least 200 twists per meter, more preferably 300 to 600 twists/meter, to result in the two filaments elongating and retracting as a single filament.

As previously mentioned, the elasticity of the fabric in warp direction ($E_{warp}$) is at least 25% (ASTM D3107 MODIFIED (Stretch) after 3 home wash), and elasticity of the fabric in weft direction ($E_{weft}$) is higher than the elasticity in warp direction ($E_{warp}$) or the elasticity of the fabric in weft direction ($E_{weft}$) is at least 30% (ASTM D3107 MODIFIED (Stretch) after 3 home wash), and elasticity of the fabric in warp direction ($E_{warp}$) is higher than the elasticity in weft direction ($E_{weft}$)

According to preferred embodiments of the present inventions, the elasticity in warp direction is preferably at least 30% more preferably at least 40% according to ASTM D3107 MODIFIED (Stretch) after 3 home wash.

Due to the fact that $E_{weft}$ is higher than $E_{warp}$ *or* $E_{warp}$ is higher than $E_{weft}$, the comfort level of the bi-stretch fabric of the invention is improved. This improvement is obtained because, when $E_{warp}$ is lower than, the warp yarns of the bi-stretch fabric can provide a better support against the gravity; at the same time, a higher $E_{weft}$ allows a better shaping of the body in vertical direction and when $E_{warp}$ higher than $E_{weft}$, allows a better shaping of the body in horizontal direction.

In a preferred embodiment, an elastic woven fabric, according to the present invention, has an elasticity in the warp direction ($E_{warp}$) comprised in the range of 25% to over 75%, preferably 25% to 90%, more preferably 30% to 90%, most preferably 30% to 60%, according to ASTM D3107 MODIFIED (Stretch) after 3 home wash), and the elasticity in the weft direction ($E_{weft}$) comprised in the range of 30% to over 150%, preferably 30% to 150%, more preferably 50% to 140%, measured according to ASTM D3107 MODIFIED (Stretch) after 3 home wash).

In a preferred embodiment, the elastic woven fabric of the present invention has the elasticity in warp direction ($E_{warp}$) of at least 25%, and the elasticity in weft direction ($E_{weft}$) of at least 30% (ASTM D3107 MODIFIED (Stretch) after 3 home wash); in a more preferred embodiment, elasticity in warp direction ($E_{warp}$) is at least 25% and elasticity in weft direction ($E_{weft}$) is at least 40% (ASTM D3107 MODIFIED (Stretch) after 3 home wash).

In a preferred embodiment, the elastic woven fabric of the present invention has the elasticity in weft direction ($E_{weft}$) that is twice the elasticity in warp direction ($E_{warp}$), preferably $E_{weft}$ is two to three times $E_{warp}$ Another advantage of the bi-stretch fabric of the present invention is that, providing high elasticity in both warp and weft direction, an improvement of recovery, and a reduction of the growth, is obtained.

According to an exemplary embodiment, the improvement of the performance is obtained by the bi-stretch fabric of the present invention because it is more elastic than what people need in daily life. In this view, a normal daily use does not require the use of all elastic and elongation capacity of the fabric. Therefore the fabric of the invention will not be overstretched or stressed, thus avoiding damages and lacking of performance, such as lacking of recovery, growth increasing, and bagging.

For example, in the so called "super-skinny" garments, the garment's cut is usually smaller than the normal body size. Therefore, just wearing super skinny garments, causes the stretching of the fabric which the garments are made of. In view of this fact, a normal use can cause overstretching of the fabric of the super-skinny garment, thus causing damages to the fabric and bagging, e.g. at knees and elbows.

The bi-stretch fabric of the present invention allows to avoid these problems. In particular, these problems are avoided because the fabric of the invention is able to move with human skin, i.e. is able to move as human skin does.

The elastic corespun yarn, in a preferred embodiments has an English cotton count ranging from 4 Ne to 150 Ne, preferably from 10 Ne to 80 Ne, more preferably 12 Ne to 60 Ne.

The elastic woven fabric of preferred embodiments has a weight in the range of 3 oz/yard$^2$ to 20 oz/yard$^2$ after wash (according to ASTM D3776), preferably from 4 oz/yard$^2$ to 15 oz/yard$^2$, more preferably from 7 oz/yard$^2$ to 14 oz/yard$^2$.

In a particularly preferred embodiment, the bi-stretch fabric of the present invention is a denim fabric.

An elastic woven fabric according to the present invention can be produced by a process characterized by determining the minimum warp elasticity required, and weaving warp yarns and weft yarns, wherein said woven fabric is elastic in both warp and weft direction, characterized in that the elasticity of the fabric in warp direction is at least 25%, preferably at least 30% (ASTM D3107 MODIFIED (Stretch) after 3 home wash), and elasticity of the fabric in weft direction ($E_{weft}$) is higher than the elasticity in warp direction ($E_{warp}$). Preferably $E_{weft}>E_{warp}$, more preferably $E_{weft}\geq 2E_{warp}$, most preferably, the value of $E_{weft}$ is two to three times the value of $E_{warp}$ or the elasticity of the fabric in weft direction is at least 30%, preferably at least 40% (ASTM D3107 MODIFIED (Stretch) after 3 home wash), and elasticity of the fabric in warp direction ($E_{warp}$) is higher than the elasticity in weft direction ($E_{weft}$). Preferably $E_{warp}>E_{weft}$, more preferably $E_{warp}\geq 2E_{weft}$, most preferably, the value of $E_{warp}$ is two to three times the value of $E_{weft}$.

As mentioned, in a preferred embodiment of the invention, the fabric is not heat set, i.e. it does not undergo a thermal treatment to set its elasticity to a pre-set value. It was surprisingly found that when the elastic yarns of the invention are used, in particular the elastic yarns above disclosed by reference to WO2012/062480, the resulting fabric does not have to be heat-set to avoid the occurrence of problems such as curling and torqueing. However, as discussed above, a fabric according to the invention can optionally undergo a thermal treatment.

Possible combinations of stretch values (elasticity) measured by ASTM D3107 (stretch) after three home washings, are 30-75; 33-35; 53-75; 27-65; 28-50; 35-100; 40-100 40-120, where the elasticity is given for warp-weft.

Figure 1A:
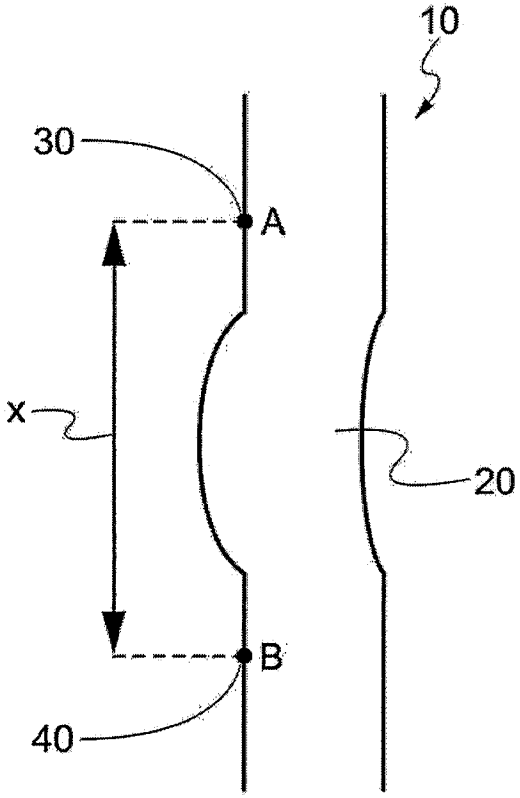

Making reference to FIGS. 1A and 1B, the minimum warp elasticity required can be determined by measuring the variation in the distance between two benchmark points "A" 30 and "B" 40 taken at two opposite ends of a joint 20, such as an elbow, or a knee, along the axis of the limb 10, e.g. an arm or a leg, on the skin of the future user.

For example, in order to make trousers, the determination will be carried out on a knee, namely above and below a knee; on the contrary, if the purpose is to obtain a fabric to make shirts, the minimum warp elasticity required will be determined on an elbow.

In FIG. 1A, i.e. when the limb 10, for example an arm or a leg is unbent, two benchmarks "A" 30 and "B" 40 are taken at two opposite ends of a joint 20, such as an elbow, or a knee, along the axis of the limb 10, i.e. the arm or the leg.

The distance between benchmark "A" 30 and benchmark "B" 40 when the limb, e.g. the arm or the leg, is unbent is, for example, of the value X. When the arm or the leg is bent, as shown in FIG. 1B, the distance, measured along the skin of the limb 10, i.e. along the skin of the leg or arm, between benchmark "A" 30 and benchmark "B" 40, taken at two opposite ends of a joint 20, increases to a value Y. The percentage of the variation of distance X to distance Y, is calculated with the formula (Y−X)/X. The result thus obtained, indicates the minimum warp elasticity required for a fabric according to the present invention.

Therefore, in a preferred embodiment, the minimum warp elasticity required is at least of the value calculated using formula (Y−X)/X, wherein X is the distance between two benchmarks, i.e., making reference to FIGS. 1A and 1B, "A" 30 and "B" 40, taken at two opposite ends of a joint 20, along the axis of a limb 10, when the limb 10 is unbent, and Y is the distance between the same two benchmarks when the limb 10 is bent.

The fabric of the present invention is woven in order to obtain an elastic woven fabric having $E_{warp}$ that is greater, preferably at least twice to value (Y−X)/X.

In a most preferred embodiment, the warp elasticity $E_{warp}$ of the fabric of the present invention is 20%, preferably 30%, more preferably 40% higher than the value (Y−X)/X.

Another object of the invention is a process for preparing an elastic woven fabric as above disclosed, characterized by determining the minimum warp elasticity required for said fabric, selecting an elastic yarn and a rigid yarn to be used at least in the warp yarns, and weaving warp yarns and weft yarns, wherein said woven fabric being elastic in both warp and weft direction, characterized in that the elasticity of the fabric in warp direction is at least 30% (ASTM D3107 MODIFIED (Stretch) after 3 home wash), and elasticity of the fabric in weft direction ($E_{weft}$) is higher than the elasticity in warp direction ($E_{warp}$).

In the process, the minimum warp elasticity required for said fabric is calculated using formula (Y−X)/X, wherein X is the distance between two benchmarks taken at two opposite sides of a joint, along the axis of a limb, when the limb is unbent, and Y is the distance between the same two benchmarks when the limb is bent.

Figure 2:
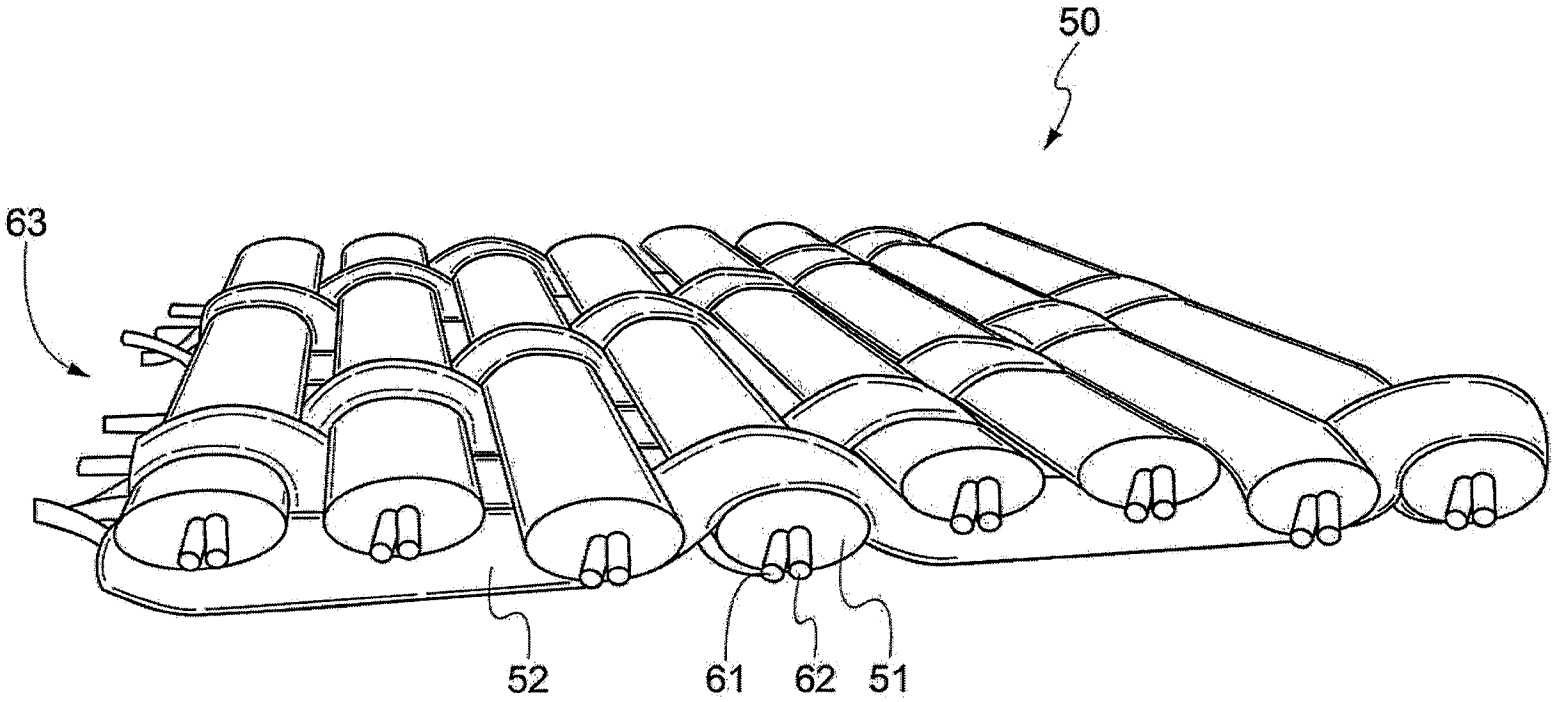
FIG. 2 is a perspective schematic view of an exemplary embodiment of the fabric.

FIG. 2 shows a woven fabric according to the invention. In FIG. 2 a woven fabric 50 has warp yarns 51 and weft yarns 52. In the core of a warp yarns 51, are present a first fiber 61 and a second fiber 62. In the same way, core fibers 63, comprising both first and second fibers, of weft yarns 52 are shown.

As previously discussed, second fibers are less elastic than first fibers.

In FIG. 2 is shown a particularly preferred embodiment of the woven fabric according to the invention that is a bi-directional stretch fabric. In a more preferred embodiment, said fabric is denim.

The bi-stretch fabric of the invention is suitable to produce clothing articles at least comprising it. For example, clothing articles that can comprise the elastic woven fabric of the present invention can be leggings, pants, T-shirts, sweaters, jackets and any other garment.

The following table shows the advantages of a fabric according to the invention as far as growth of the fabric is concerned.

TABLE 1

| Required elasticity % | Growth for 80% elastic fabric (ASTM D3107) | Growth for 50% elastic fabric (ASTM D3107) | Growth for 20% elastic fabric (ASTM D3107) |
|---|---|---|---|
| 10 | 1 | 1 | 1 |
| 20 | 1.5 | 3 | 6 |

TABLE 1-continued

| Required elasticity % | Growth for 80% elastic fabric (ASTM D3107) | Growth for 50% elastic fabric (ASTM D3107) | Growth for 20% elastic fabric (ASTM D3107) |
|---|---|---|---|
| 30 | 2 | 4 | — |
| 40 | 3 | 5 | — |
| 50 | 4 | 7 | — |
| 60 | 5 | — | — |
| 65 | 5.5 | — | — |
| 70 | 5.8 | — | — |
| 75 | 7.5 | — | — |
| 80 | 10 | — | — |

In the above table, the required elasticity is the elasticity determined or measured as previously discussed; e.g. it is known that the elasticity required for the fabric of a legging or skinny jeans is 20% when the actually fabric used has a 20% elasticity, the result would be a growth of the fabric with use and resulting bagging at the knees. Additionally, any holding and shaping power of the fabric would be decrease with time.

If for the said legging or jeans garment the used fabric has elasticity of 50%, the growth will be only 3 or 1.5 if a fabric having 80% elasticity is used. Similarly, if the required elasticity is 50%, the use of a 50% elastic fabric will result in a growth of 7% of the fabric compared to a growth of 4% if a fabric having 80% elasticity is used.

It is an advantage of the invention that the final garment using the invention can be customized to the final user's body structure; in fact, by measuring the required elasticity on the user's body as previously mentioned it is possible to select a garment having the elasticity that better suits the user's body characteristics.

Figure 3:
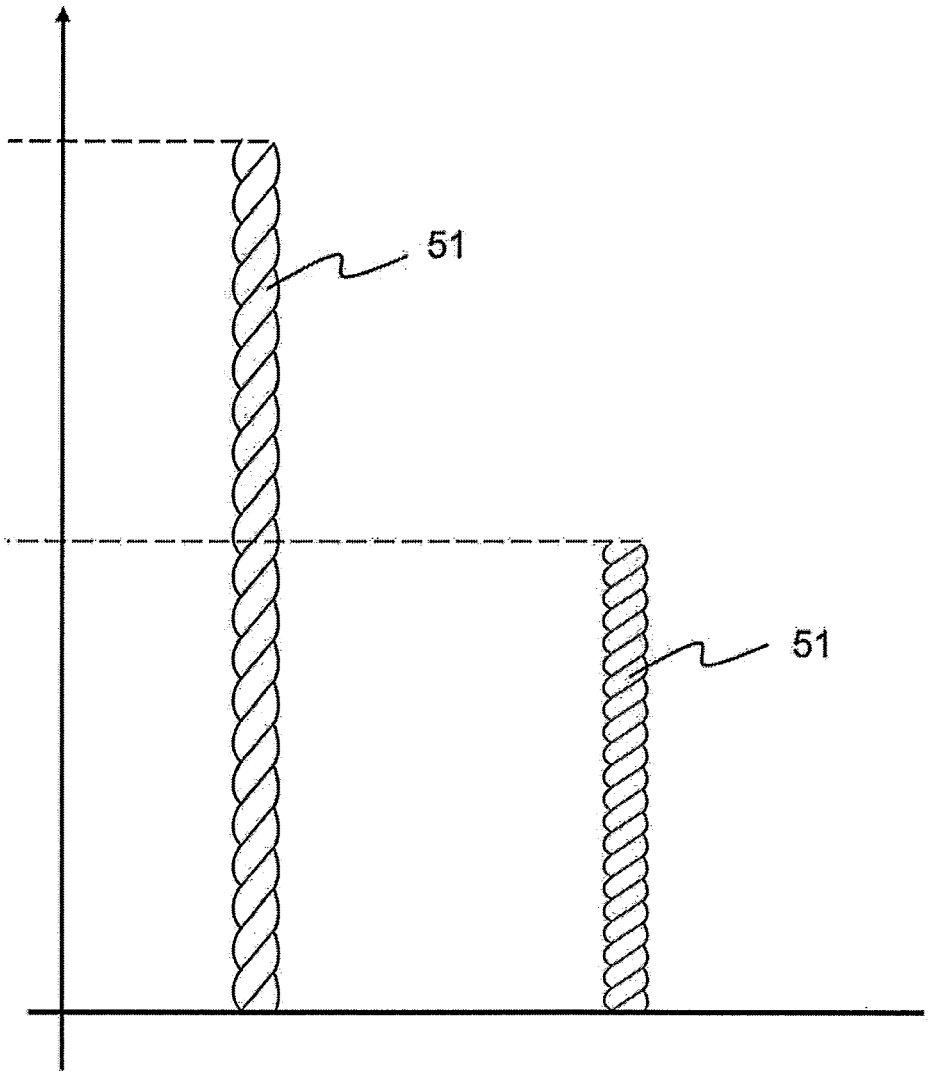
FIG. 3 is a schematic view of the difference in the twist level of the warp yarn before weaving and in the finished fabric.

With reference to FIG. 3, a schematic view of the shrinking of a fabric, and of its effect on the warp yarn twist level is shown. In particular, on the left, the twist level of a warp yarn 51 at the beginning of the fabric production step is shown, while, on the right, the twist level of the same warp yarn 51 in the finished fabric is shown. For clarity, only the warp yarn 51 (and not the fabric) is shown. As mentioned, in order to obtain the desired twist level of the warp yarns in the finished fabric, the warp yarn 51 is produced with a low twist level, so that at the beginning of the fabric production the twist level of the warp yarn is lower than the final one.

As before mentioned, in fact, when the fabric shrinks in the warp direction, the twist level of the warp yarn 51 in the fabric increases. The initial twist level is thus chosen so as to obtain the desired twist level at the end of the fabric production steps, taking into account the fabric elasticity in the warp direction, as well as the expected shrinkage of the fabric in the warp direction during the fabric production steps.

Preferably, the twist level of the warp yarns 51 in the finished fabric is provided with a twist multiplier comprised between 2.5 and 6, more preferably between 3 and 5, most preferably between 3.5 and 4.7. According to a possible embodiment, to obtain such a desired twist level, the warp yarn is produced with a twist level having a twist multiplier comprised between 2.0 and 4.5, more preferably between 2.5 and 4.3, most preferably between 2.6 and 4. In other words, during the fabric production, the fabric shrinks and the twist level of the warp yarns increases, from the condition before weaving (e.g. having a twist multiplier between 2 and 4.5) with respect to the condition in the finished fabric.

As mentioned before, preferably, the initial twist level of the warp yarn (before weaving) is chosen as a function of the shrinkage of the fabric, i.e. as a function of the initial length of the warp yarn (before weaving) and of the final length of the warp yarn (i.e. in the fabric). In other words, the initial twist level of the warp yarn can be determined with the following formula:

$$IT=DT*FL/IL$$

wherein IT is the initial twist of the warp yarn, DT is the desired twist of the warp yarn in the fabric (i.e. the final twist level), FL is the final length of the warp yarn in the fabric, IL is the initial length of the warp yarn before being woven.

As an example, if the fabric shrinks for 30% of its length (e.g. from 100 to 70 cm), the initial twist level is 30% smaller than the desired twist level in the finished fabric (e.g. the warp yarn has initially a twist multiple of 2.8 to obtain the a warp yarn with desired twist multiple 4.0 in the final fabric).

The invention claimed is:

1. A woven fabric comprising elastic warp yarns and elastic weft yarns, said elastic warp yarns and elastic weft yarns each having a stretchable core and an inelastic fibers sheath covering said core, said stretchable core including a first elastic fiber and a second fiber that is less elastic than said first elastic fiber, said woven fabric having an elasticity in warp direction of at least 25% (measured according to ASTM D3107-Stretch) and elasticity in weft direction of at least 40% (measured according to ASTM D3107-Stretch), and said elastic warp yarns having a twist level with a twist multiplier in the range of 2.5 to 6, wherein elasticity of the fabric in weft direction ($E_{weft}$) is higher than the elasticity in warp direction ($E_{warp}$) or wherein elasticity of the fabric in warp direction ($E_{warp}$) is higher than elasticity in the weft direction ($E_{weft}$).

2. The woven fabric according to claim 1, wherein the twist multiplier is in the range of 3.5 to 4.7.

3. The woven fabric according to claim 1, wherein:

said first elastic fiber and said second fiber are intermingled with a number of connecting points within the range of 20 to 1000 twists per meter;

said elasticity in said weft direction is greater than said elasticity in said warp direction;

said second fiber comprises a PBT elastomultiester, a bicomponent PTT/PET or PTT/PBT, or nylon; and said first elastic fiber comprises a polyolefin elastomer or a polyurethane elastomer.

4. The woven fabric according claim 1, wherein said first elastic fiber is stretchable to at least 400% of an initial length of said first elastic fiber and said second fiber is stretchable to at least 20% of an initial length of said second fiber but is less stretchable than said first elastic fiber.

5. The woven fabric according to claim 1, wherein said woven fabric comprises denim.

6. A clothing article comprising a woven fabric comprising elastic warp yarns and elastic weft yarns, said elastic warp yarns and elastic weft yarns each having a stretchable core and an inelastic fibers sheath covering said core, said stretchable core including a first elastic fiber and a second fiber that is less elastic than said first elastic fiber, said woven fabric having an elasticity in warp direction of at least 25% (measured according to ASTM D3107-Stretch) and elasticity in weft direction of at least 40% (measured according to ASTM D3107-Stretch), and said elastic warp yarns having a twist level with a twist multiplier in the range of 2.5 to 6, wherein elasticity of the fabric in weft direction ($E_{weft}$) is higher than the elasticity in warp direction ($E_{warp}$) or wherein elasticity of the fabric in warp direction ($E_{warp}$) is higher than elasticity in the weft direction ($E_{weft}$).

7. The clothing article according to claim 6, wherein the twist multiplier lies in the range of 3.5 to 4.7 and said elasticity in weft direction is greater than said elasticity in warp direction.

8. The clothing article according to claim 6, wherein said first elastic fiber is stretchable to at least 400% of an initial length of said first elastic fiber and said second fiber is stretchable to at least 20% of an initial length of said second fiber, said second fiber being less stretchable than said first elastic fiber.

9. The clothing article according to claim 6, wherein:

said first elastic fiber and said second fiber are intermingled with a number of connecting points within the range of 20 to 1000 twists per meter;

said elasticity in said weft direction is greater than said elasticity in said warp direction;

said second fiber comprises a PBT elastomultiester, a bicomponent PTT/PET or PTT/PBT, or nylon; and said first elastic fiber comprises a polyolefin elastomer or a polyurethane elastomer.

* * * * *